United States Patent [19]

Beck et al.

[11] Patent Number: 4,709,823

[45] Date of Patent: Dec. 1, 1987

[54] TAMPER EVIDENT BOTTLE OR PACKAGE CLOSURE

[75] Inventors: James M. Beck, 290 Iowa Ct., Carol Stream, Ill. 60188; Robert D. Rohr, Elgin, Ill.

[73] Assignee: James M. Beck

[21] Appl. No.: 11,111

[22] Filed: Feb. 5, 1987

[51] Int. Cl.[4] ..... B65D 41/32

[52] U.S. Cl. ..... 215/235; 215/251; 215/254

[58] Field of Search ..... 215/235, 237, 251, 250, 215/254, 255

[56] References Cited

U.S. PATENT DOCUMENTS

| | | | |
|---|---|---|---|
| 3,952,901 | 4/1976 | Conti | 215/251 |
| 4,111,324 | 9/1978 | Winchell | 215/251 X |
| 4,487,324 | 12/1984 | Ostrowsky | 215/235 X |

*Primary Examiner*—Donald F. Norton

*Attorney, Agent, or Firm*—Hill, Van Santen, Steadman & Simpson

[57] ABSTRACT

An anti-tamper container closure assembly includes a container having a orifice defining neck which receives a closure cap. The container has a plurality of projecting anti-rotation teeth positioned below the bottom of the closure cap and an overcap is adapted to be snapped over the closure cap, the overcap having a skirt with inner diameter projecting anti-rotation ribs which index with the container teeth to prevent rotation of the overcap. The overcap is effective to prevent opening of the orifice and is provided with frangeable connecting portions allowing a part of the overcap to be removed from the assembly to provide access to the closure cap for an opening actuation of the closure cap. The overcap skirt is provided with an inner diameter ledge which abuts a closure cap outer diameter ledge to prevent removal of the overcap skirt.

14 Claims, 17 Drawing Figures

FIG. 1
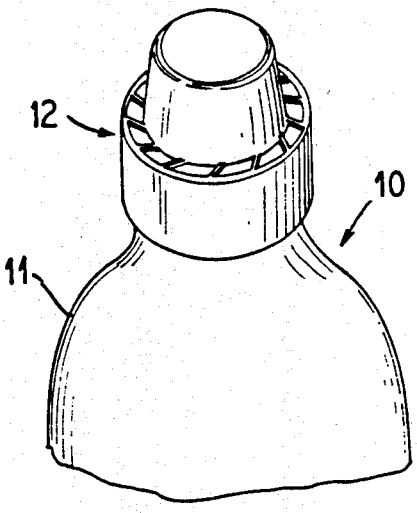
FIG. 2
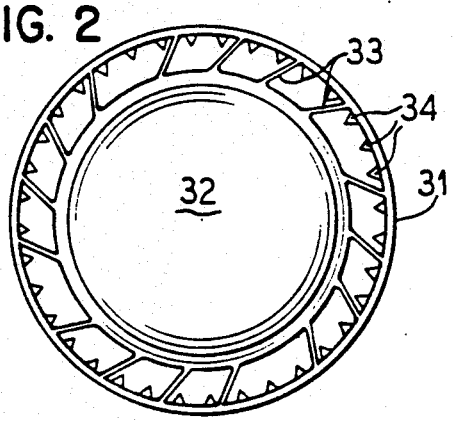
FIG. 3
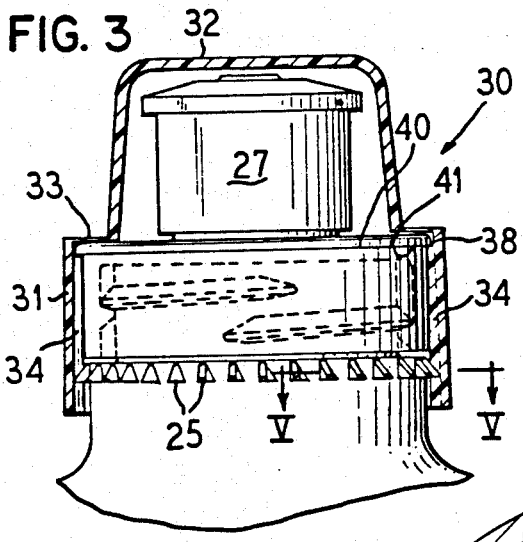
FIG. 4
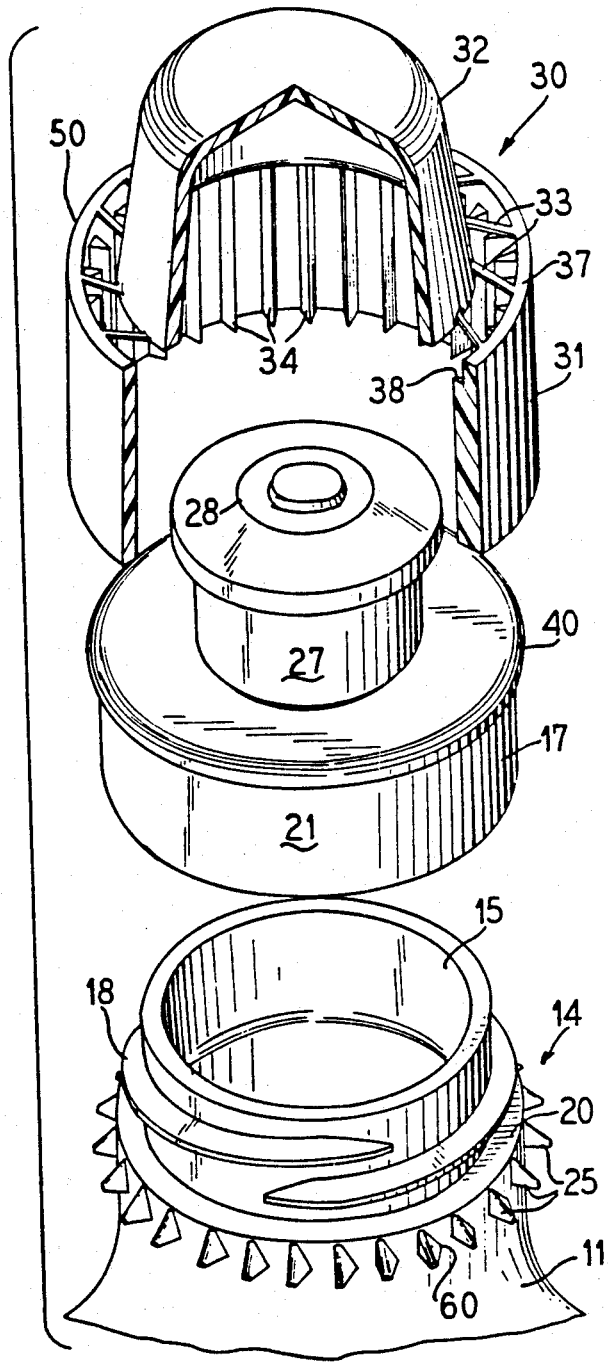
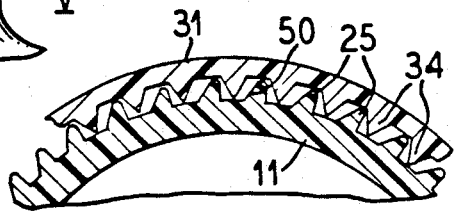
FIG. 5

TAMPER EVIDENT BOTTLE OR PACKAGE CLOSURE

BACKGROUND OF THE INVENTION

1. Field of the Invention

This invention relates to containers, more particularly to container closures.

2. Prior Art

In recent years there has been an emphasis on providing containers with closures that are resistant to opening and which, when opened, provide an indication of prior opening. A known type of such closure includes a cap structure or assembly which has a portion that interfits or indexes with a part of the container in such a way as to prevent removal of the cap. The cap portion is attached to the main body of the cap through frangeable connections which allow the removal resistant portions of the cap to be severed from the remainder of the cap by breaking the frangeable connections. One known way of constructing such caps is to construct a screw-on cap having a skirt with a inner diameter raised portion adjacent the bottom of the skirt and with the container formed with an outer diameter raised bead such that when the cap is screwed onto the container the two raised portions overlap preventing the cap from being unscrewed. By forming the cap raised portion on a part of the cap skirt connected to other parts of the cap through frangeable connections, it is possible to separate the anti-removal feature from the remainder of the cap thereby allowing the cap to be removed. A disadvantage with this particular type of construction is that a portion of the cap is, in fact, removed and discarded such that it is not always easy to detect whether or not the container has been previously opened due to the fact that the frangeable anti-removal portion has been discarded and the remaining portion still functions as a normal cap. Another disadvantage with this type of construction is that it has to be put on by automatic capping machinery as a part of the regular threading on process and the frangeable connections can be easily broken during factory capping. Another disadvantage, particularly associated with that type of closure where the anti-removal portion remains on the container or on the closure cap, is that it is often difficult to break the frangeable connection.

Other types of tamper evident closures include the use of overcaps which are secured either to a nonremovable closure cap or to a portion of the container and which, when in position, prevent access to the closure cap. While it has been suggested to make such overcaps in such a manner as to include frangeable connections facilitating intentional removal of the overcap, such assemblies have not generally been easily assembled by standard manufacturing assembly techniques on container filling lines.

It would therefore be an advance in the art to provide an improved tamper indicating closure assembly adaptable to substantially all types of closures, wherein the structure readily gives indication of previous opening and wherein the assembly can be automated and the frangeable connection easily broken.

SUMMARY OF THE INVENTION

Our invention provides a tamper resistant, tamper indicating closure assembly which is readily adaptable to different types of dispensing and non-dispensing caps and which consists of an overcap which can be assembled to the container by merely pressing the overcap down onto the container and which when affixed to the closure on the container is nonrotatable and nonremovabe.

In the preferred form, the invention includes a container having a neck portion defining an orifice for the container. The neck portion is provided with a plurality of radially extending teeth or lugs spaced from the open end of the dispensing neck. A regular cap structure is assembliable onto the container in the normal manner and could include either screw-on type caps or press-on type caps. An overcap is provided with a skirt having a plurality of inner diameter axially extending ribs terminating in space relationship to an end portion of the overcap which will overlie a portion of the top of the closure cap. The closure cap is provided with a radially extending bead adjacent to its top having a thickness less than the distance between the under side of the top of the overcap and the top of the ribs and having a radial dimension greater than the inner diameter of the ribs and less than or equal to the inner diameter of the skirt. The overcap's skirt is resilient so as to be attachable to the closure cap by being pushed down over the overcap and circumferentially expanding to accommodate the radial bead of the overcap until the bead passes above the top of the ribs. The overcap will then constrict so that the ribs and the face of the closure cap bead provide an anti-removal abutment for the skirt of the overcap. The ribs of the overcap index with the projecting teeth of the container to prevent rotation of the overcap. The top of the overcap is affixed to the skirt by means of a frangeable connection. The top of the overcap functions to prevent removal or opening of the closure cap.

In a first embodiment, for use in connection with pull-to-open push-to-close dispensing caps, the top of the overcap includes a central domed cup-shaped section dimensioned to be received over the push/pull dispensing valve with the outer periphery of the cup-shaped portion connected to the skirt by frangeable brace members. When the overcap is assembled to the dispensing cap, access to the push/pull member is blocked by the dome portion, the overcap is restrained against removal by the abutment between the ribs of the overcap skirt and the radial projection of the container cap bead, and rotation of the container cap to unthread it is prevented by the anti-rotation abutment of the projections on the container and the ribs on the inner diameter of the overcap skirt. Thus, the container cannot be opened and the contents thereof cannot be tampered with or dispensed. In order to provide access to the dispensing valve, the dome portion must be severed by breaking of the frangeable connections. When this occurs, the dome portion may be discarded, however, the skirt portion remains in position on the container providing a telltale indication of tampering.

In a second embodiment, particularly adapted for use with a hinged stopper-type dispensing closure caps, the central dome portion can be eliminated and the overcap provided with an annular ring top connected to the skirt by frangeable connections. By assembling the overcap so that the annular ring overlies a portion of the pivotable stopper so as to prevent the stopper from pivoting, the overcap will prevent opening or tampering. Again, removal of the annular ring by breaking of the frangeable connection will allow the dispensing cap to be opened and used but will still leave the skirt attached to the container. This style of overcap can also be used with nondispensing container caps.

In a third embodiment, the removable annular ring can be provided with a pull ring affixed thereto.

It is, therefore, a principal objection of this invention to provide an improved tamper resistant, tamper evident closure assembly for containers.

It is another important object of this invention to provide a tamper resistant, tamper indicating closure assembly for containers utilizing an overcap preventing removal of or opening access to, a closure cap, the overcap being prevented from rotation by abutment with container carried projections, the overcap being equipped with a frangeable portion which, when removed, allows access to the closure cap.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a perspective view of a container equipped with the container closure assembly of this invention.

FIG. 2 is a top plan view of the container closure overcap.

FIG. 3 is a side plan view, partially in section of the assembly of FIG. 1 showing underlying portions by dotted lines.

FIG. 4 is an exploded view of the assembly of FIG. 1.

FIG. 5 is a fragmentary sectional view taken along the lines V—V of FIG. 3.

DESCRIPTION OF THE PREFERRED EMBODIMENT

Figure 6:
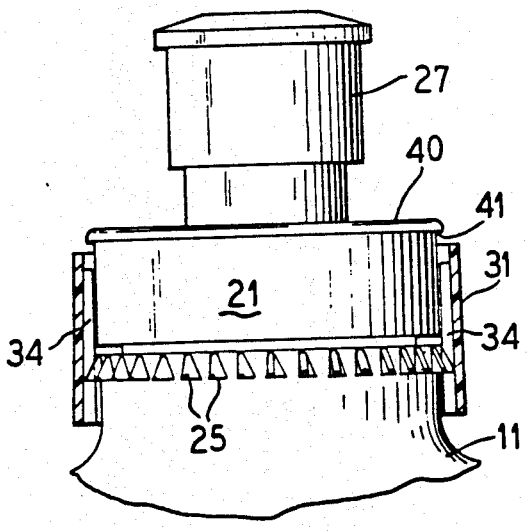
FIG. 6 is a view similar to FIG. 3 showing the assembly after breaking of the frangeable connection and removal of the center portion.
Figure 8:
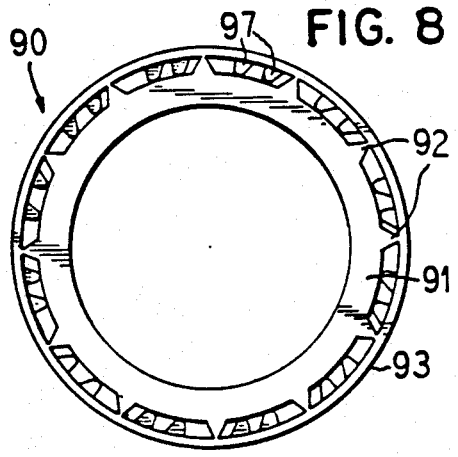
FIG. 8 is a top plan view of the assembly of FIG. 7.
Figure 9:
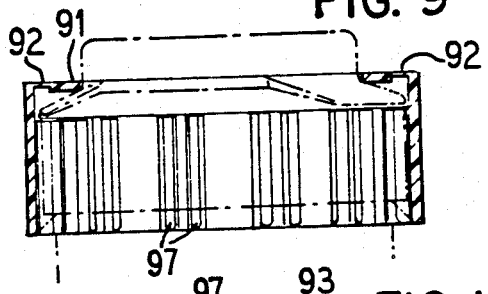
FIG. 9 is a sectional view of the assembly of FIG. 7 showing underlying portions and dotted lines.

FIG. 1 illustrates a cap and container assembly 10 consisting of a container 11 and cap assembly 12. The container can be of any type and constructed of any suitable material such as glass or plastics. As best shown in FIG. 4, the container 11 is provided with a neck 14 defining a filling and dispensing opening 15 and including means for affixing a closure cap 17. In the illustrated embodiment the means are threads 18. The neck of the container 11 is provided with a radial ledge 20 having a radial extent generally at least as great as the radial thickness of the skirt 21 of the closure cap 17. Below the ledge 20 the container is provided with a plurality of radial projecting lugs or teeth 25 which serve as anti-rotation members.

The cap illustrated in connection with the first embodiment is a push/pull dispensing cap of the type having an outer valving member 27 which defines a dispensing opening 28 which is opened or closed by moving the member 27 vertically with respect to the remainder of the cap. Such dispensing caps are well known and will not further be described except that, as is known, when the portion 27 is pushed down, the opening 28 is sealed. An overcap 30 is provided, the overcap including a skirt portion 31 and a top portion 32 with the two portions interconnected by frangeable connectors 33. The inner diameter of the skirt portion 31 has a plurality of longitudinally extending ribs 34 which terminate in spaced relation to the skirt top 37 at radial ledge and faces 38. The dispensing cap 17 is provided with an outer diameter increasing, top portion 40 which provides a circumferential bead which defines a radial ledge 41. The inner diameters of the ribs 34 are approximately the same as the outer diameter of the skirt 21 below the ledge 41 so that the ledge surfaces 38 at the top of the ribs 34 can underlie the ledge 41.

Preferably the skirt portion 31 of the overcap is constructed of a material which is resilient allowing the skirt portion to be circumferentially expanded to be slipped over the bead 40 of the closure cap 17 until the surfaces 38 and 41 are pushed axially past one another, at which time the skirt portion 31 will resiliently constrict snapping the skirt into place on the closure cap with the surfaces 38 and 41 preventing removal of the overcap from the closure cap. The skirt 31 is axially longer than the skirt 17 so that the ribs 34 extend below the closure cap and into the area of the projections 25. The projections 25 have a radial extent approximately equal to the inner diameter of the skirt 31 in the area between the ribs 34 whereby the ribs 34 will alternate with the projections 25 providing an anti-rotation feature. Thus, when the overcap is in position, as illustrated in FIG. 3, it will not be possible to rotate the overcap with respect to the container and therefore it will not be possible to unscrew the closure cap 17. Moreover, it will not be possible to remove the overcap due to the interference of the ledge surfaces 38 and 41.

In the embodiment of FIGS. 1–6, the overcap is provided with a domed central top portion 32 dimensioned to receive the push/pull valve 27 with the valve in the closed condition. The dome portion 32 prevents access to the valve portion 27 so that it cannot be moved to dispensing position. It can thus be seen that the overcap provides an anti-tamper seal member for the container and closure cap.

When it is desired to open the assembly to allow dispensing, the domed top 32 is broken away from the skirt 31 by breaking the frangeable connectors 33. This can generally be accomplished by a forceful rotation of the top portion 32 which will cause the members 33 to break away from the skirt. When this occurs, as illustrated in FIG. 6, the skirt 31 can drop down on the neck of the container 11. The amount of drop can be controlled by controlling the shape of the container neck and can, for example, be a very minor amount so that the skirt 31 still prevents unthreading access to the closure cap or a greater amount allowing unthreading access to the periphery of the closure cap. In the embodiment illustrated in FIG. 6, it will be seen that the skirt 31 has dropped a very small amount such as to make it impractical to grasp enough of the periphery of the closure cap 17 to allow that cap to be unthreaded. Because the valve top 29, shown in its raised position, rotates freely on the remainder of the closure cap, this assembly is desirable for disposable single filling containers. Where it is desired to provide the capability of unthreading the closure container, the container can be constructed with a longer neck allowing the skirt to be moved further downward on the neck freeing a greater extent of the periphery of the closure cap for grasping.

When the frangeable connectors 33 have been broken, they provide a telltale indication of tampering. Because the skirt 31 remains attached to the container, it serves as a warning that the container has potentially been opened. It will be appreciated that this invention provides other tamper resistant features. First, because the skirt and container neck can be dimensioned so the skirt does not drop down enough to allow removal of the closure cap, it discourages intentional disquised tampering in that it becomes difficult to remove the closure cap for replacement with another closure cap and unbroken overcap. Secondly, because the skirt remains affixed to the container and closure cap, it is not possible to attach a unbroken overcap without first, in some manner, effecting removal of the skirt.

It will be appreciated that because the overcap is applied simply be pressing it down into position, and because the force can be applied at the annular top of the skirt 50 without placing pressure on the domed top portion 32, there is a reduced possibility of breaking the frangeable connectors 33 during automated assembly.

As illustrated at 60 on FIG. 5, the projections 25 of the container can be formed with a sloped face on one side so that the mating of the abutment surfaces of the ribs 34 and the projections 25 can be in the manner of a one-way ratchet allowing the skirt to be rotated in one direction only on the container. This can allow for tightening of the closure cap 17 while still functioning to prevent unthreading of the cap.

Figure 10:
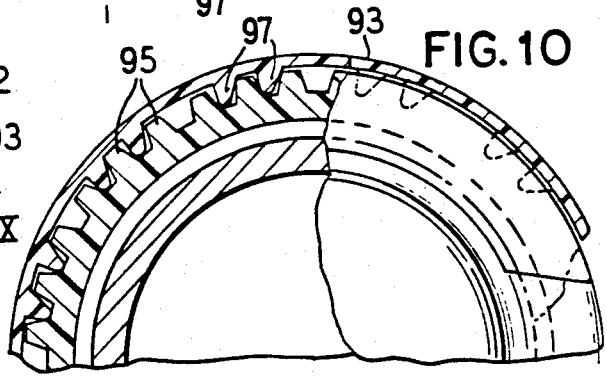
FIG. 10 is a fragmentary part sectional view of the assembly of FIG. 7 along lines X—X.
Figure 11:
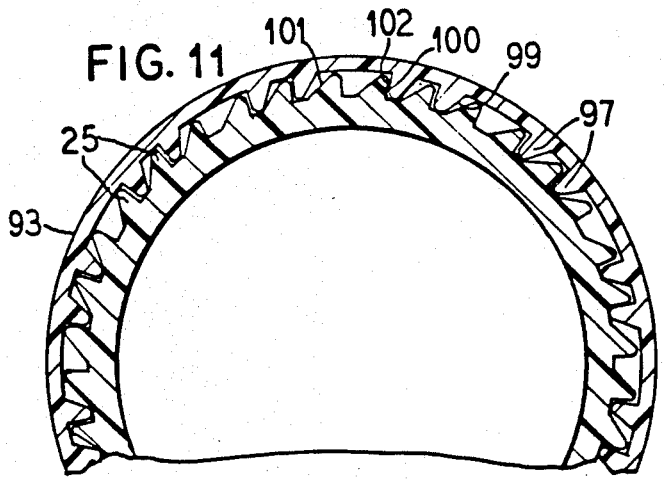
FIG. 11 is a fragmentary part sectional view of the assembly of FIG. 7 along lines XI—XI.
Figure 12:
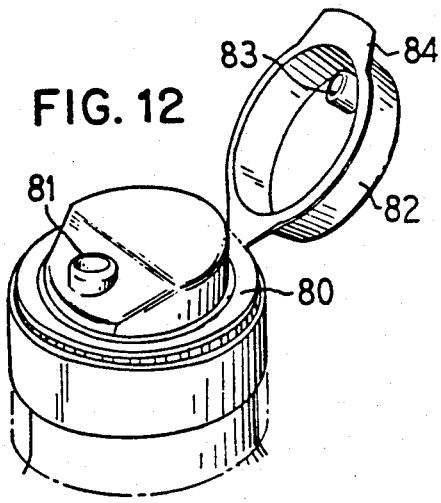
FIG. 12 is a perspective view of the assembly of FIG. 7 after removal of the frangeable connection showing the container cap in a dispensing position.
Figure 13:
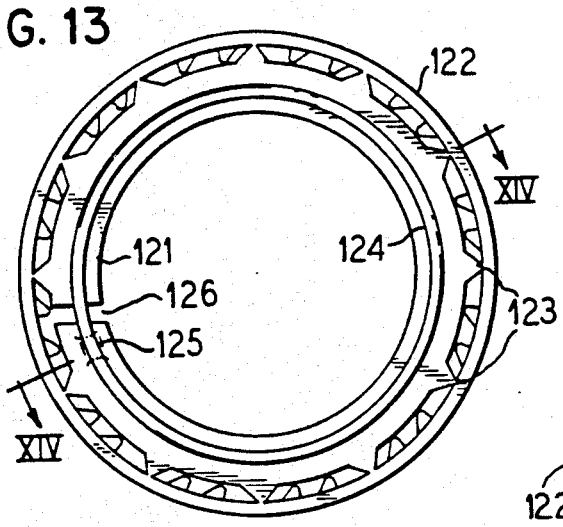
FIG. 13 is a top plan view of a third embodiment of the invention.
Figure 14:
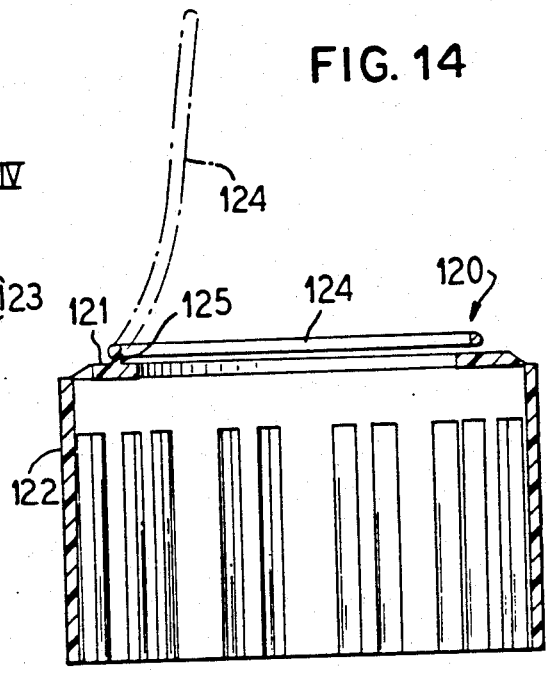
FIG. 14 is a sectional view taken along the lines XIV—XIV of FIG. 13 illustrating by broken lines, the liftability of the removal ring.

FIGS. 7–12 show a second embodiment of the invention particularly adaptable for use with hinged stopper caps of the type illustrated in FIG. 12 where the container closure cap 80 includes a dispensing orifice 81 and a pivotable or hinged stopper member 82 equipped with a plug 83 for closing the orifice 81. In the embodiment illustrated in FIG. 12, the hinged member 82 is shown as a cup-shaped hat-like member, however, it will be understood that this invention is equally useable with flat tang like pivoted stopper carrying members. Common to such structures is a lip member 84 which projects from the unhinged side of the stopper carrying member 82 and which is used as a thumb push member. In this embodiment the overcap 90 is provided with an annular ring 91 connected by frangeable connections 92 to a skirt 93. Thus, the ring 91 replaces the dome like center 32 of the embodiment of FIG. 1. The ring 91, when the overcap is attached to the container overlies the lip member 84 preventing the pivoted member 82 from being pivoted up while the ring is in place. The frangeable connectors 92 allow the ring to be broken away.

Figure 7:
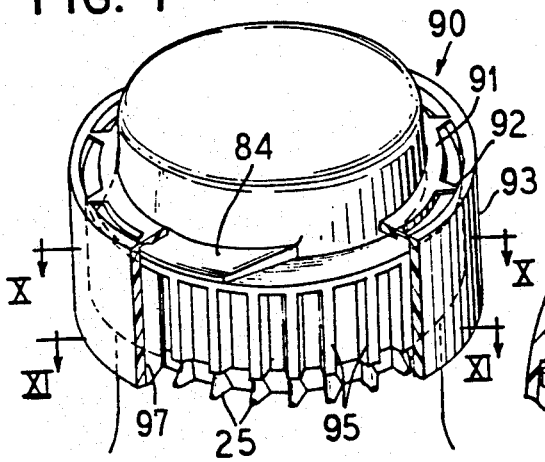
FIG. 7 is a perspective view, partly broken away, illustrating a second embodiment of the invention where the closure cap is provided with a rib structure complimentary to the rib structure of the overcap.

As best illustrated in FIG. 7 and 10, the cap 80 can be provided with ribs 95 on the outer diameter of its skirt. The ribs 95 can index with the ribs 97 of the skirt of the overcap so as to provide an anti-rotation feature between the dispensing cap and the skirt of the overcap. This can be particularly useful when the sloped face projections 25 of the container are used to provide a one-way rotation for the dispensing cap by rotation of the overcap. In such a structure, it is possible for the overcap to be preassembled to the closure cap prior to attachment of the closure cap to the container on the filling line. As shown in FIG. 11, the ribs 97 of the overcap can be provided with a sloped face 99 and a radial face 100 which cooperate with a sloped face 101 of the projections 25 and a radial face 102 to enhance the one-way anti-rotation in the manner of a one-way ratchet.

Figure 15:
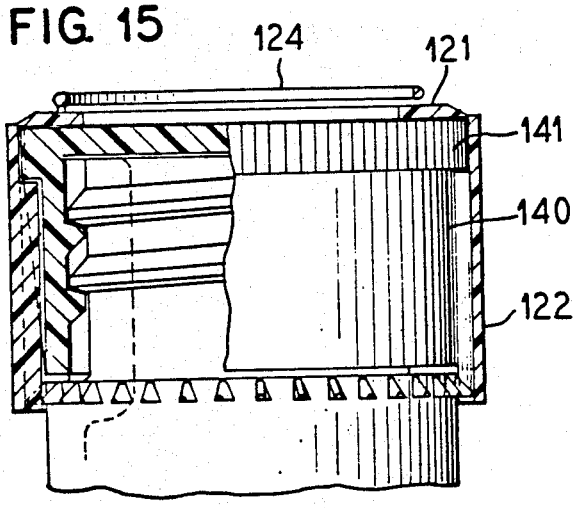
FIG. 15 is a part fragmentary side plan view of the assembly of FIG. 13.
Figure 17:
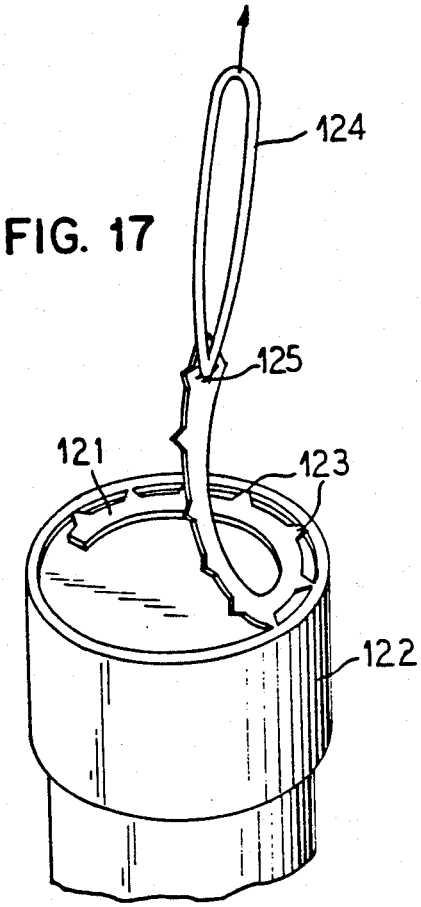
FIG. 17 is a diagramatic view of the assembly of FIG. 13 showing removal of the frangeable portion.
Figure 16:
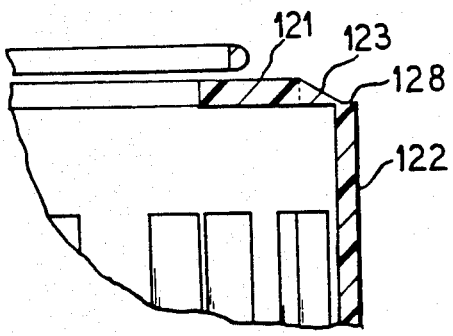
FIG. 16 is an enlarged fragmentary sectional view of a top corner of the overcap of the assembly of FIG. 13.

FIGS. 13–17 illustrate a third embodiment, particularly suitable for use with flat top closure caps. In this instruction the overcap 120 is provided with, an annular ring 121 similar to the ring 91 of FIG. 7 which is connected to the skirt 122 through frangeable connections 123. The ring 121, however, carries a second ring member or loop 124 positioned axially above the ring 121 and connected to the ring 121 at one point 125 in its circumference, the ring 124 being unconnected to the ring 121 for the remainer of the circumference. In this manner the ring 124, particularly when the cap is molded of a flexible plastic, serves as a liftable tear away loop for tearing off the ring 121 by breaking the frangeable connections 123. To enhance tearability, the ring 121 can have a gap 126 adjacent to the point of connection 125 such that the ring 121 is not a complete annulus. In order to insure frangeability and to simplify molding, the frangeable connector 123 may be easily formed, as illustrated in FIG. 16, by raising the ring 121 above the top 128 of the skirt 122 and tapering down radial projecting portions at the outer periphery of the ring to form the frangeable connections 123.

As best shown in FIG. 15, this embodiment is particularly useful with flat top closures 140 where the ring 125 overlies the top adjacent the periphery. This prevents the top from being unscrewed from the container. However, as previously discussed, by utilizing a longer neck container, the skirt 122 of the overcap can drop down below a peripheral portion of the container closure after removal of the ring 121. By forming the upper outer periphery of the container cap with a knurled portion 141, the container closure cap can then be easily removed by unthreading it from the container, thus opening the container.

It can, therefore, be seen that our invention provides an improved tamper resistant, tamper evident container closure assembly utilizing an overcap having an interior rib skirt with ribs that index with container projections to provide an anti-rotation feature, the ribs terminating in an upper ledge which is abutable against a lower ledge face of a container closure cap to prevent the overcap from being removed, and the overcap having a frangeable connection to a top portion which overlies a part of the container closure preventing the container closure from being opened or removed from the container.

Although the teachings of our invention have herein been discussed with reference to specific theories and embodiments, it is to be understood that these are by way of illustration only and that others may wish to utilize our invention in different designs or applications.

We claim:

1. A tamper resistant container closure assembly comprising a container having an orifice associated with a container neck, a closure cap for said orifice having top portions, means carried by the container and by the closure cap for affixing the closure cap to the container closing said orifice, an overcap receivable over said closure cap, said overcap having a peripheral skirt for surrounding a peripheral portion of said closure cap and of said container neck, anti-rotation means carried by said skirt and by said container interacting to resist rotation of said skirt with respect to said container in at least one rotational direction, abutable, opposed surfaces on said closure cap and said overcap resisting removal of said skirt in a direction away from said container, said overcap having end portions thereof overlying top portions of said closure cap, said end portions effective to prevent said closure cap from being acted upon to open said orifice, said end portions being connected to said skirt through frangeable connections whereby said end portions may be broken away from said skirt to allow said closure cap to be acted upon to open said orifice.

2. The closure assembly of claim 1 wherein the abutable opposed surfaces include a radial ledge on the closure cap and radial ledge surfaces on the inner diameter of the skirt.

3. The assembly of claim 2 wherein the anti-rotation means includes circumferentially spaced apart projections extending radially outwardly from portions of said container and radial projections extending radially inwardly from said skirt.

4. The assembly of claim 3 wherein the radial projections of said skirt comprises circumferentially spaced apart ribs formed on an inner diameter surface of said skirt.

5. The assembly of claim 4 wherein said ribs terminate in spaced relationship to said end portions with a top surface of said ribs forming said radial ledge surfaces.

6. The container closure assembly of claim 5 wherein said end portions comprise a domed cup-shaped portion, and wherein said closure cap includes a push/pull valve assembly having portions thereof extending into the hollow interior of the cup-shaped portion, the cup-shaped portion projecting beyond an end of the skirt and having an outer diameter adjacent its open end less than an inner diameter of the skirt, the frangeable connections extending between an inner diameter of the skirt and the outer diameter of the cup-shaped portion.

7. The closure assembly of claim 6 wherein the cup-shaped portion is dimensioned to prevent the push/pull valve from being positioned in a valve open condition when the overcap is assembled onto the container cap.

8. The container closure assembly according to claim 5 wherein the end portions comprises an annular ring having an outer diameter less than or equal to the inner diameter of the skirt portion, the frangeable connections connecting the ring to the skirt.

9. The container assembly according to claim 8 wherein the closure cap includes a pivotable stopper member having a projecting tang on a side opposite a pivotable connection to remaining portions of the closure cap and said ring overlies said tang when said stopper is in an orifice closing position and said overcap is assembled to said closure cap.

10. A container closure assembly according to claim 8 wherein said ring has affixed thereto a pull tab ring.

11. A tamper resistant container closure assembly comprising a container having an orifice defined by a neck, a closure cap affixable to said neck closing said orifice, an overcap assemblable onto said closure cap, a plurality of radial projections formed on said container below said closure cap projecting radially beyond said closure cap, said overcap having a skirt portion, a plurality of radial inwardly projecting ribs on said skirt portion, said ribs having an inner diameter equal to or greater than the outer diameter of a major portion of the closure cap and less than or equal to the outer diameter of the projections, said closure cap having a radially projecting ledge adjacent a top surface thereof, said ribs terminating in abutment surfaces opposing said radially projecting ledge when said overcap is affixed to said closure cap, said overcap having a top portion overlying said top surface whereby the portion of said closure cap between said top surface and said radially projecting ledge is entrapped between said top portion and said rib end surfaces, and said top portion connected to said skirt by frangeable connections allowing the top portion to be broken away from said skirt.

12. The assembly of claim 11 wherein said skirt is dimensioned to be movable toward said container when said frangeable connections are broken to allow peripheral access to said closure cap.

13. The assembly of claim 11 wherein said projections and said ribs are dimensioned to provide a one-way rotation ratchet.

14. The assembly of claim 13 wherein said container cap includes a skirt portion, said skirt portion having projecting ribs adapted to inter-lock with the ribs of the overcap skirt to provide anti-rotation between the closure cap and the overcap.

* * * * *